US008082615B1

(12) United States Patent
Alkhattaf

(10) Patent No.: US 8,082,615 B1
(45) Date of Patent: Dec. 27, 2011

(54) THERMAL BREATHING BED

(76) Inventor: Solaiman B. S. A. Alkhattaf, Qadsia (KW)

( * ) Notice: Subject to any disclaimer, the term of this patent is extended or adjusted under 35 U.S.C. 154(b) by 0 days.

(21) Appl. No.: 13/004,535

(22) Filed: Jan. 11, 2011

(51) Int. Cl.
*A61G 7/00* (2006.01)

(52) U.S. Cl. ..... 5/655; 5/706; 5/933; 5/713

(58) Field of Classification Search ..... 5/600, 706, 5/710, 713, 655.3, 727, 933, 655
See application file for complete search history.

(56) References Cited

U.S. PATENT DOCUMENTS 3,981,032 A 9/1976 Brooks
4,066,072 A 1/1978 Cummins
4,730,604 A 3/1988 Boggs
5,503,618 A 4/1996 Rey
6,256,965 B1 7/2001 Sheridan
7,475,441 B1 1/2009 Soberal
2008/0092295 A1* 4/2008 Flick et al. ..... 5/600
2009/0089931 A1* 4/2009 Vandenbelt ..... 5/639

* cited by examiner

*Primary Examiner* — Fredrick Conley
(74) *Attorney, Agent, or Firm* — Lowe Hauptman Ham & Berner, LLP

(57) ABSTRACT

The present invention provides an infant bed having a support frame, an elastically inflatable mattress removably disposed on the support frame, an inflating and heating apparatus operably connected to the elastically inflatable mattress, wherein the inflating and heating apparatus continuously circulates heated air through the elastically inflatable mattress vibrating, expanding, and contracting an upper sleeping surface of the elastically inflatable mattress.

1 Claim, 1 Drawing Sheet

THERMAL BREATHING BED

TECHNICAL FIELD

The present invention is generally directed toward an infant bed, and more particularly, to an infant thermal breathing bed that simulates a mother's chest movement mimicking the inhalation and exhalation of air.

BACKGROUND OF THE INVENTION

Many prior art infant mattresses having various comfort features have been developed in recent years. Most of these infant mattresses have been used to address the issues related to infant apnea and sleeplessness.

For example, U.S. Pat. No. 4,730,604, to Boggs discloses a baby bed having an air mattress connected to a bubble chamber for vibrating the mattress in an arrhythmic manner to prevent apnea.

Another approach is disclosed in U.S. Pat. No. 4,066,072, to Cummins, in which a comfort cushion for infants provides a fluid filled mattress, and an alarm system for alerting a heartbeat change of the infant.

Yet a further recent approach is disclosed in U.S. Pat. No. 7,475,441, to Soberal, in which a baby comforting apparatus provides recording of actual mother's heartbeat and the mother's breathing.

One of the disadvantages associated with these prior art infant mattresses is the lack of support means to prevent the infant from rolling off the mattress, as well as lack of means for using a sound producing and thermal pillow.

It is therefore a primary object of the present invention to provide an infant thermal breathing bed with an inflatable mattress and support means in combination with a thermal and heartbeat sound mechanism to mimic the inhalation and exhalation of a mother's chest.

Notwithstanding the above, it is presently believed that there may be a significant demand for an infant thermal breathing bed having the above-stated features of the present invention.

SUMMARY OF THE INVENTION

These problems and others are addressed by the present invention which comprises and/or consists of an infant bed having a support frame, an elastically inflatable mattress removably disposed on the support frame, an inflating and heating apparatus operably connected to the elastically inflatable mattress, wherein the inflating and heating apparatus continuously circulates heated air through the elastically inflatable mattress vibrating, expanding, and contracting an upper sleeping surface of the elastically inflatable mattress.

BRIEF DESCRIPTION OF DRAWINGS

These and other objects of the present invention will be appreciated and understood by those skilled in the art from the detailed description of the preferred embodiments of the invention and the following drawings of which:

FIG. 2-A is a sectional and enlarged view of the inflating and heating apparatus taken along line A-A shown in FIG. 2; and, FIG. 2-B is an enlarge perspective view of the pillow and the sound-producing device shown in FIG. 2.

DETAILED DESCRIPTION OF THE INVENTION

Figure 1:
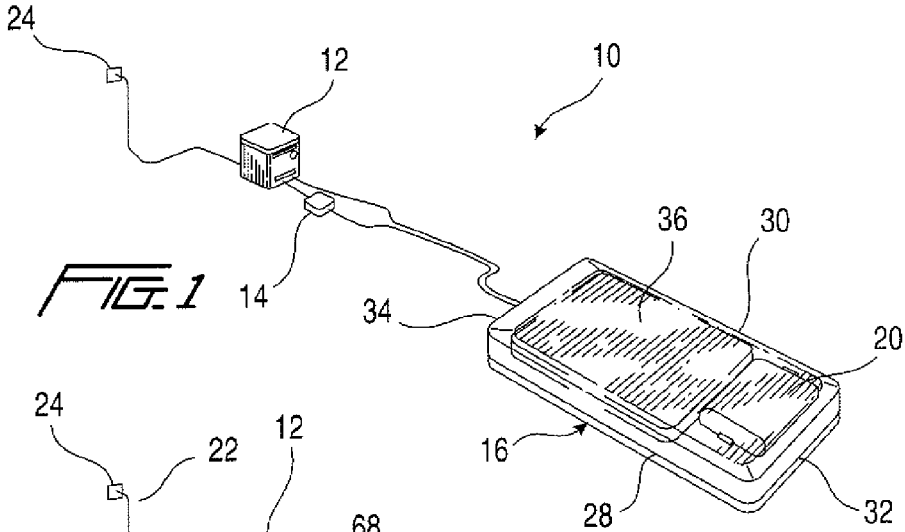
FIG. 1 is a perspective view of the thermal breathing bed, the inflating and heating apparatus, and the elastically inflatable mattress in a deflated configuration according to the present invention.

For the purpose of promoting and understanding of the principles of the invention, reference will now be made to the embodiments illustrated in the drawings. Referring now to the drawings, and more specifically FIG. 1, wherein the showings are for the purpose of illustrating the preferred embodiment of the invention only and not for the purpose of limiting the same, a thermal breathing bed 10 is illustrated generally having an inflating and heating apparatus 12, an airflow and timer regulator 14, an infant bed frame generally designated at 16, an elastically inflatable mattress 18, and a pillow 20. As will be described in greater detail herein, the inflating and heating apparatus 12 is AC power operated having an electrical cord 22 plugged into a power outlet 24, or in the alternative, may be battery power operated using a rechargeable battery 26, which can be continually charged when the inflating and heating apparatus 12 is plugged into the power outlet 24.

The infant bed frame 16 has a substantially rectangular shape and configuration, although other shapes and configurations, for example, but not limited to, circular or oval, are contemplated to be within the scope of the present invention. The infant bed frame 16 comprises a first side 28, a second side 30, a third side 32, and fourth side 34 bounding a mattress supporting housing 36 therewithin, wherein the first, second, third, and fourth sides 28, 30, 32, and 34, respectively, are shaped and dimensioned to have a selected height greater than that of the elastically inflatable mattress 18 in a fully inflated form, thereby providing a peripheral boundary for protecting the asleep infant from rolling off the bed. That is, the height of the fully inflated mattress with the arrhythmic and vibrating movement will always be lower than the upper peripheral edges of the bed frame sides.

Figure 2:
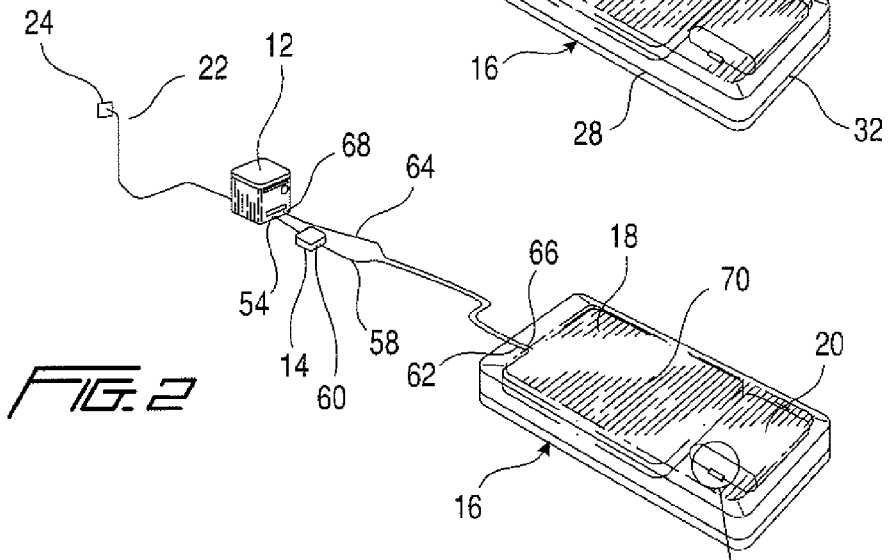
FIG. 2 is a perspective view of the thermal breathing bed with the elastically inflatable mattress in an inflated configuration shown in FIG. 1.
Figure 2A:
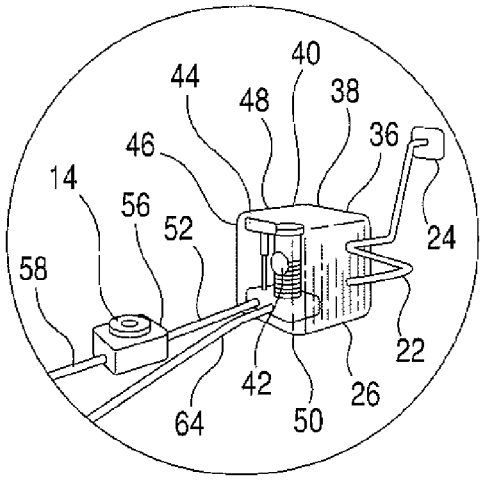
Figure 2B:
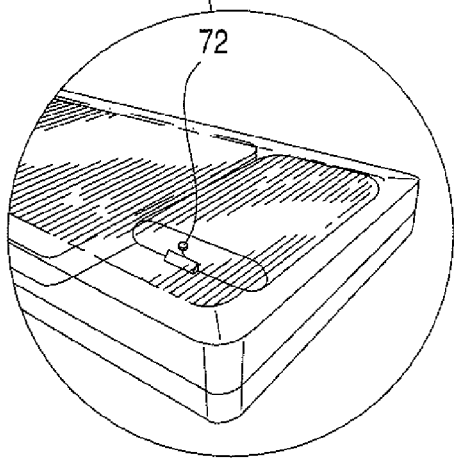

Referring now to FIG. 2-A, the inflating and heating apparatus 12 includes a housing 36 bounding an opening therewithin for housing an electrically operated air pump 38, an air heating unit 40 operable through a thermostat 42, an ON/OFF switch 44 having a light indicator 46 for manually and completely shutting down the inflating and heating apparatus 12, and an air release valve 48 for deflating the elastically inflatable mattress 18 when desired, for example, for storage purposes. The air pump 38, the air heating unit 40, and the air release valve 48 are operably connected through a conduit support 50, wherein the air pump 38 supplies and circulates the air through the elastically inflatable mattress 18 and through the air heating unit 40 set with the desired air temperature using the thermostat 42 to warm up the elastically inflatable mattress 18.

The airflow may be regulated by (timer device-14) to select the desired time of work, letting air go through the heater to get the desired air temperature then through the designated inlet pipe all the way to the elastically inflatable mattress (the inhale process). After that, the air flows to the out of the outlet pipe to produce a simulated exhale.

A first inlet pipe 52 is connected to the conduit support inlet 54 at one end, and operably connected to the airflow and timer regulator outlet at a second end 56. A second inlet pipe 58 is connected to the airflow and timer regulator inlet at one end 60, and operably connected to the elastically inflatable mattress outlet at a second end 62. An outlet pipe 64 is operably connected to the elastically inflatable mattress inlet at one end 66, and operably connected to the conduit support and air pump outlet at a second end 68. As will be explained in greater detail, the desired air pumping speed and its pulsating time interval are controlled by the air flow and timer regulator set at desired speed and time interval, and the air temperature is set through the thermostat, wherein warm air is pumped and continuously circulated through the outlet pipe 64, within the elastically inflatable mattress 18, and back through the first inlet pipe 52 and second inlet pipe 58. It is noted that the inlet and outlet pipes are preferably made from such material as, but not limited to, PVC or other type of hard or flexible plastic material.

The air pump and air heating unit are designed in a way to permit the pressured air to go through the heated air produced by the aforementioned unit before going through the inlet pipe to the inflatable mattress.

The elastically inflatable mattress 18 is dimensioned and configured to be removably placed within the infant bed frame housing 36. The elastically inflatable mattress 18 includes an upper sleeping surface area 70. When warm or cold air is pumped and circulated through the elastically inflatable mattress 18 with the use inflating and heating apparatus 12, the air flows into the mattress through the inlet 62 and, continuously circulates within the elastically inflatable mattress 18 causing the upper sleeping surface area 70 to vibrate, expand out and contract simulating inhalation and exhalation of a mother's chest while breathing, and circulates out through the outlet 66. When the inflating and heating apparatus 12 is turned off using the ON/OFF switch 44, the elastically inflatable mattress 18 will remain inflated without vibrating or expanding movements so long as the air release valve 48 is closed. When it is desired to move the elastically inflatable mattress 18 when traveling or for storage purposes, the air release valve 48 is opened thereby allowing the elastically inflatable mattress 18 to deflate.

As stated hereinabove in connection with the height of the fully inflated elastically inflatable mattress 18, it is also contemplated that the overall shape and configuration of the elastically inflatable mattress 18 in a fully inflated configuration maybe of such that the upper sleeping surface area 70 will expand and vibrate in somewhat of a slight concave manner providing further infant rollover preventing means together with the four sides of the infant bed frame 16.

Pillow 20 comprises a sound-producing device 72 removably installed on an edge thereof, wherein the sound-producing device 72 is battery operated and can generate soothing music and sounds for helping the infant to fall asleep, or in the alternative, it is contemplated the sound-generating device 72 can have pre-recorded sounds of the mother's heartbeat which can be played back in order to relax the baby.

The sound device is a digital recording device. It has a recording, playback and erase capability that enables a user to record his/her voice to play it back to the baby when it is put to sleep. However, it should preferably include a factory recorded combination of musical voices such as music (classic, soft and soothing music) and natural voices such as the sound of water, birds, etc.

While preferred embodiments of the invention have been shown and described, various modifications and substitutions may be made thereto without departing from the spirit and scope of the invention. Accordingly, it is to be understood that the present invention has been described by way of illustration only, and this description should not be construed as limiting to the several claims appended hereto.

What is claimed is:

1. A combination consisting of:

an infant bed having a support frame, an electrically inflatable mattress including an upper sleeping surface removably disposed on said support frame, an AC powered inflating and heating apparatus and an electrical cord plugged into a power source and operatively connected to said elastically inflatable mattress and wherein said inflating and heating apparatus further consists of an air pump, an air heating unit, a thermostat and an airflow and timer regulator; and an alternative rechargeable battery and a battery charger which continuously charges the battery when the inflating and heating apparatus is plugged into the power output;

a first inlet pipe connected to said air heating unit at one end and to said airflow and timer regulator at a second end;

a second inlet pipe connected to said airflow and timer regulator at one end and to said elastically inflatable mattress at a second end, an outlet pipe connected to said air pump at one end and to said elastically inflatable mattress inlet at a second end; and, wherein said inflating and heating apparatus continuously circulates heated air through said electrically inflatable mattress vibrating, expanding, and contracting said upper sleeping surface of said elastically inflatable mattress; and wherein said airflow and timer regulator adjusts the air pressure flow and duration thereof at a desired level to create a pulsating and vibrating movement on said elastically inflatable mattress;

said combination further comprising a pillow having a sound-producing device removably disposed on an edge thereof and wherein said pillow further comprises a heating element disposed therein; and, wherein said infant bed frame bordering said mattress is shaped and dimensioned to have a selected height greater than that of the elastically inflatable mattress in a fully inflated form to thereby provide a peripheral boundary to prevent a sleeping infant from rolling off of the bed.

* * * * *